US009782052B2

(12) United States Patent
Cho et al.

(10) Patent No.: US 9,782,052 B2
(45) Date of Patent: Oct. 10, 2017

(54) NOZZLE ASSEMBLY AND DISHWASHER HAVING THE SAME

(71) Applicant: SAMSUNG ELECTRONICS CO., LTD., Suwon-si (KR)

(72) Inventors: Sung Jin Cho, Seongnam-si (KR); Dae Uk Kang, Hwaseong-si (KR); Jeong Hoon Kang, Seoul (KR); Ha Yeon Jo, Suwon-si (KR); Kwan Woo Hong, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 530 days.

(21) Appl. No.: 14/282,294

(22) Filed: May 20, 2014

(65) Prior Publication Data

US 2014/0345654 A1 Nov. 27, 2014

(30) Foreign Application Priority Data

May 21, 2013 (KR) ..... 10-2013-0057052

(51) Int. Cl.
*A47L 15/22* (2006.01)
*A47L 15/42* (2006.01)
*A47L 15/23* (2006.01)

(52) U.S. Cl.
CPC ..... *A47L 15/22* (2013.01); *A47L 15/23* (2013.01); *A47L 15/4282* (2013.01)

(58) Field of Classification Search
CPC ..... A47L 15/4282
See application file for complete search history.

(56) References Cited

U.S. PATENT DOCUMENTS 6,325,083 B1 12/2001 Wörter
7,988,791 B2 * 8/2011 Delgado ..... A47L 15/22 134/56 D
2012/0279536 A1 11/2012 Adams et al.

FOREIGN PATENT DOCUMENTS

DE 10 2006 012 080 A1 9/2007
EP 0 795 292 A2 9/1997
EP 1 040 786 A1 10/2000
(Continued)

OTHER PUBLICATIONS

European Office Action dated May 2, 2016 in corresponding European Patent Application No. 14 169 356.4.
(Continued)

*Primary Examiner* — Jason Ko
(74) *Attorney, Agent, or Firm* — Staas & Halsey LLP

(57) ABSTRACT

A nozzle assembly and a dishwasher having the same. The dishwasher includes a main body, a wash tub, and at least one first nozzle assembly to wash the objects received in the wash tub. The first nozzle assembly includes a main nozzle configured to be rotatable about a rotation axis thereof, plural injection holes, a first flow path defined in the main nozzle for movement of wash water to be sprayed out toward the objects, a sub nozzle provided at the main nozzle, the sub nozzle internally defining a second flow path for movement of wash water to be sprayed out in a radial direction of the main nozzle, and a valve coupled to the main nozzle to open or close the second flow path. Providing the nozzle assembly with the first and second flow paths independent of each other may reduce noise due to collision of wash water.

21 Claims, 15 Drawing Sheets

(56) References Cited

FOREIGN PATENT DOCUMENTS

| | | |
|---|---|---|
| KR | 10-2008-0006407 | 1/2008 |
| KR | 10-2012-0057193 | 6/2012 |
| WO | 01/19229 A1 | 3/2001 |

OTHER PUBLICATIONS

European Search Report dated Oct. 8, 2014 and issued in corresponding European Patent Application 14169356.4-1710.
European Decision on Grant dated Jun. 13, 2017 in corresponding European Patent Application No. 14169356.4.

* cited by examiner

NOZZLE ASSEMBLY AND DISHWASHER HAVING THE SAME

CROSS-REFERENCE TO RELATED APPLICATIONS

This application claims the priority benefit of Korean Patent Application No. 10-2013-0057052, filed on May 21, 2013 in the Korean Intellectual Property Office, the disclosure of which is incorporated herein by reference.

BACKGROUND

1. Field

The following description relates to a nozzle assembly having an improved configuration to reduce noise generated in a dishwasher and a dishwasher having the same.

2. Description of the Related Art

A dishwasher is an apparatus that automatically removes food residue adhered to objects to be washed, for example, bowls, spoons, and various cooking utensils (hereinafter referred to as 'dishes') using detergent and wash water.

In general, a dishwasher includes a main body in which a wash tub is placed, a rack assembly placed in the wash tub in a withdrawable manner, and a nozzle assembly to spray wash water. Dishes are stored in the rack assembly and washed by wash water sprayed out from the nozzle assembly.

There are a rotatable type nozzle assembly which sprays wash water while rotating about a rotation axis thereof and a linear type nozzle assembly which linearly sprays water.

The dishwasher includes a door to open or close the wash tub, and a detergent box is positioned at the door to supply detergent into the dish washer.

Conventionally, the nozzle assembly sprays wash water toward the detergent box to wash the detergent box. However, when the nozzle assembly sprays wash water in a state in which it is rotated rearward of the dishwasher, the wash water colliding with the wash tub may generate noise.

SUMMARY

Additional aspects and/or advantages will be set forth in part in the description which follows and, in part, will be apparent from the description, or may be learned by practice of the disclosure.

Therefore, it is an aspect of the present disclosure to provide a nozzle assembly and a dishwasher having the same, which may provide an improved wash water flow path to reduce noise due to collision between wash water and a wash tub.

Additional aspects of the disclosure will be set forth in part in the description which follows and, in part, will be apparent from the description, or may be learned by practice of the disclosure.

In accordance with an aspect of the present disclosure, a dishwasher includes a main body, a wash tub placed within the main body to receive objects to be washed therein, and at least one first nozzle assembly located within the wash tub to wash the objects received in the wash tub, the first nozzle assembly being configured to spray wash water while being rotated, wherein the first nozzle assembly includes a main nozzle configured to be rotatable about a rotation axis thereof, a plurality of injection holes, through which wash water is sprayed out, a first flow path defined in inner portion of the main nozzle for movement of wash water to be sprayed out toward the objects, at least one sub nozzle provided at the main nozzle, the sub nozzle internally defining a second flow path for movement of wash water to be sprayed out in a radial direction of the main nozzle, and a valve coupled to the main nozzle to open or close the second flow path.

The second flow path may be open or closed as the main nozzle is rotated.

The valve may include a first communication hole to communicate with the first flow path and a second communication hole to communicate with the second flow path.

The sub nozzle may be coupled to an outer surface portion of the main nozzle.

The valve may be coupled to the main nozzle to penetrate the main nozzle, and the second communication hole to communicate with the second flow path may be located outside the main nozzle.

The sub nozzle may protrude forward of the main nozzle to prevent the main nozzle from switching an injection direction of wash water sprayed out from the sub nozzle.

The sub nozzle may be located inside the main nozzle.

The dishwasher may further include a guide configured to guide wash water downward of the main nozzle when the second flow path is closed.

The guide may be provided at a lower surface of the main nozzle and may have a curved inner surface to guide movement of wash water.

The at least one sub nozzle may include a plurality of sub nozzles.

The dishwasher may further include a second nozzle assembly, and the second nozzle assembly may include a plurality of injection units arranged within the wash tub to wash the objects received in the wash tub, the injection units being configured to linearly spray wash water, and a switching unit configured to be linearly moved relative to each injection unit to switch an injection direction of wash water.

The first nozzle assembly may be located above a basket placed in the wash tub and the second nozzle assembly may be located below the basket.

The dishwasher may further include a supply pipe to supply wash water into the first nozzle assembly, and at least one coupling member to couple the supply pipe and the first nozzle assembly to each other.

The dishwasher may further include a shock-absorbing member coupled between the coupling member and the main nozzle to reduce friction between the main nozzle and the supply pipe.

In accordance with another aspect of the present disclosure, a dishwasher includes a main body, a wash tub placed within the main body to receive objects to be washed therein, and at least one first nozzle assembly located within the wash tub to wash the objects received in the wash tub, the first nozzle assembly being configured to spray wash water while being rotated, wherein the first nozzle assembly includes a main nozzle configured to be rotatable about a rotation axis thereof, a first flow path defined in the main nozzle for movement of wash water to be sprayed out in a first direction of the main nozzle, and a sub nozzle provided at the main nozzle, the sub nozzle internally defining a second flow path for movement of wash water to be sprayed out in a second direction of the main nozzle, and wherein the second flow path is open when the sub nozzle is located in a front region of the wash tub and is closed when the sub nozzle is located in a rear region of the wash tub.

Wash water moving in the first flow path may be sprayed out in a vertical direction of the main nozzle corresponding to the first direction, and wash water moving in the second flow path may be sprayed out in a horizontal direction of the main nozzle corresponding to the second direction.

The dishwasher may further include a valve coupled to the main nozzle, the valve including a first communication hole to communicate with the first flow path and a second communication hole to communicate with the second flow path, the second communication hole of the valve being selectively open or closed.

The dishwasher may further include a guide configured to come into contact with wash water so as to guide the wash water downward of the main nozzle when the second communication hole is closed.

In accordance with another aspect of the present disclosure, a dishwasher includes a main body, a wash tub placed within the main body to receive objects to be washed therein, and at least one first nozzle assembly located within the wash tub to wash the objects received in the wash tub, the first nozzle assembly being configured to spray wash water while being rotated, wherein the first nozzle assembly includes a main nozzle configured to be rotatable about a rotation axis thereof, at least one sub nozzle coupled to the main nozzle, at least one first injection hole formed in the main nozzle, through which wash water is sprayed out in a first direction, at least one second injection hole formed in the sub nozzle, through which wash water is sprayed out in a second direction, and a valve, at least a portion of which communicates with the sub nozzle, to adjust injection of wash water through the second injection hole.

The first direction may be a vertical direction of the main nozzle, and the second direction may be a radial direction of the main nozzle.

The second injection hole may be located at a radial distal end portion of the sub nozzle.

The valve may include a first communication hole to communicate with the main nozzle and a second communication hole to communicate with the sub nozzle.

The main nozzle may include a connection portion connecting the second communication hole and the sub nozzle to each other such that wash water discharged from the second communication hole is introduced into the sub nozzle.

In accordance with a further aspect of the present disclosure, a nozzle assembly includes a main nozzle configured to be rotatable about a rotation axis thereof, the main nozzle internally defining a first flow path for movement of wash water, and a sub nozzle provided at the main nozzle, the sub nozzle internally defining a second flow path for movement of wash water to be sprayed out forward of the main nozzle, wherein the second flow path is open or closed as the main nozzle is rotated.

The nozzle assembly may further include a valve coupled to the main nozzle, the valve including a first communication hole communicating with the first flow path and a second communication hole communicating with the second flow path, the second communication hole of the valve being selectively open or closed.

The main nozzle may include an upper main nozzle and a lower main nozzle arranged at upper and lower sides respectively, and the sub nozzle may be coupled to a lower surface portion of the lower main nozzle.

The lower main nozzle may be provided at the lower surface portion thereof with a first coupling ridge to couple with the sub nozzle, and the sub nozzle may be provided at an upper surface portion thereof with a first coupling groove corresponding to the first coupling ridge.

The nozzle assembly may further include a guide configured to guide wash water downward of the main nozzle when the second flow path is closed.

The sub nozzle may include a first section coupled to the guide and a second section extending from the first section.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
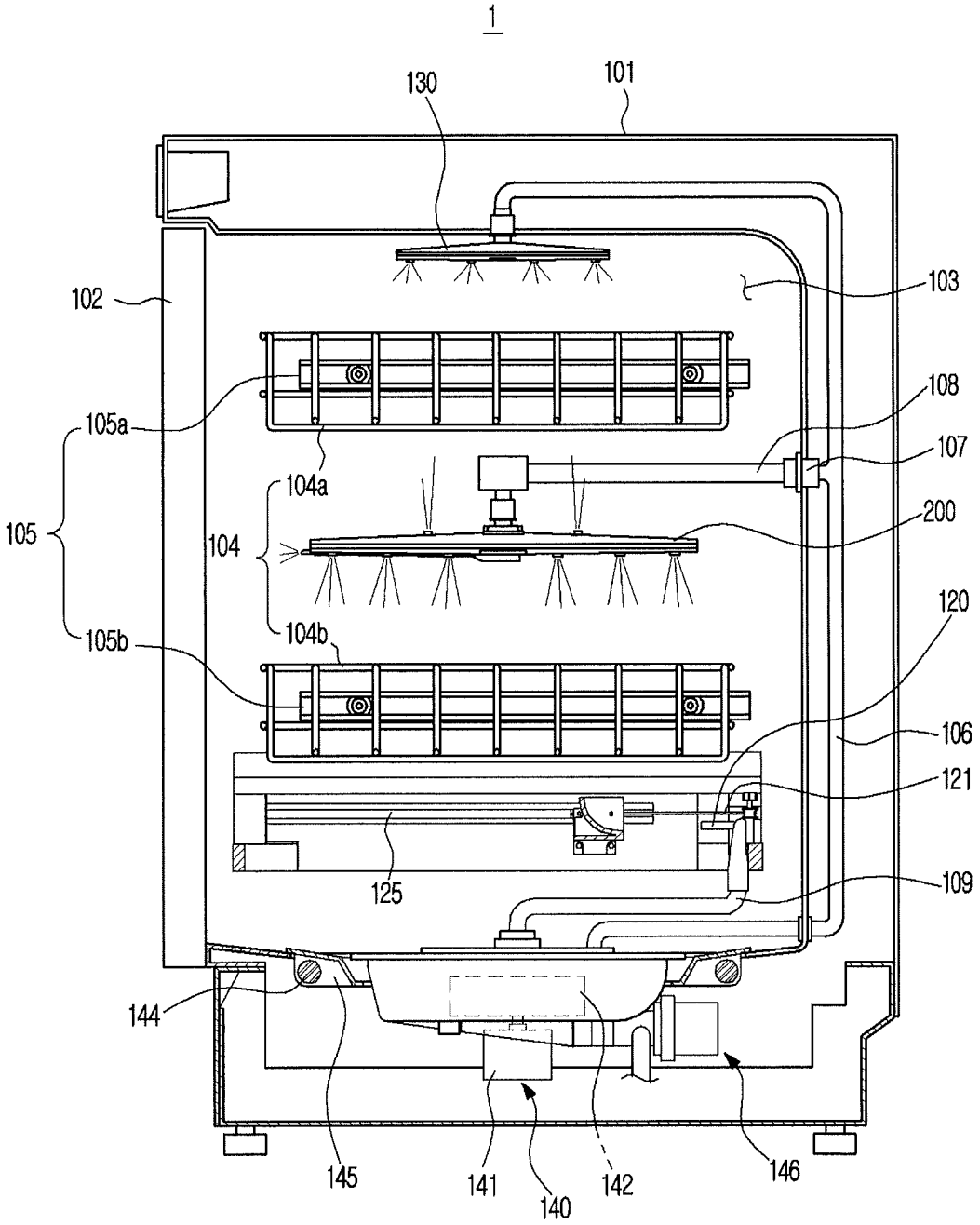
FIG. 1 is a sectional view showing a dishwasher according to an embodiment of the present disclosure.

Reference will now be made in detail to embodiments, examples of which are illustrated in the accompanying drawings, wherein like reference numerals refer to the like components throughout. Embodiments are described below to explain the present disclosure by referring to the figures.

Reference will now be made in detail to embodiments of the present disclosure, examples of which are illustrated in the accompanying drawings, wherein like reference numerals refer to like components throughout.

FIG. 1 is a sectional view showing a dishwasher according to an embodiment of the present disclosure.

As exemplarily shown in FIG. 1, the dishwasher 1 includes a main body 101 defining an external appearance of the dishwasher 1, a wash tub 103 placed within the main body 101 and defining a dish washing space, and a sump 140 placed below the wash tub 103 to store wash water therein.

An opening is formed in a front portion of the main body 101 such that objects are introduced into the wash tub 103 or removed from the wash tub 103. A door 102 is installed to the front portion of the main body 101 such that a lower end portion of the door 102 is hinged to a front lower end portion of the main body 101 to open or close the wash tub 103 via pivotal rotation thereof. A detergent box 110 (see FIGS. 9 and 10) is located on one surface portion of the door 12 to supply detergent into the wash tub 103. The detergent box 110 will be described below.

At least one basket 104 is installed in upper and lower regions of the wash tub 103 so as to be movable inward and outward. The top of each of the baskets 104 is open to provide a dish receiving portion. The baskets 104 are inserted into or withdrawn from the main body 101 through the open front portion of the main body 101 by at least one rack 105 that supports the baskets 104 in a sliding manner.

The baskets 104 are formed of wires arranged in the shape of a lattice such that objects received in the baskets 104 may be washed while being exposed outward from the baskets 104.

One or more nozzle assemblies 120, 130, 200 are mounted in the wash tub 103 to spray wash water in a plurality of directions, for example, above, below and between the two baskets 104 to enable washing of objects received in the baskets 104. These nozzle assemblies may include a first nozzle assembly 200 located below an upper basket 104*a* and a second nozzle assembly 120 located below a lower basket 104*b*. In addition, a third nozzle assembly 130 may be located above the upper basket 104*a*.

According to an embodiment of the present disclosure, each of the first nozzle assembly 200 and the third nozzle assembly 130 is rotatable about a rotation axis thereof to spray water while being rotated. The second nozzle assembly 120 may include a nozzle 121 to spray wash water from below the lower basket 104*b* toward an opposite lateral surface of the wash tub 103, and a switching member 125 to switch an injection direction of wash water. The switching member 125 is linearly movable, and thus may concentrate injection of wash water only on a prescribed zone.

The wash tub 103 may include a heater 144 to heat wash water and a heater mounting recess 145. The heater mounting recess 145 is formed in the bottom portion of the wash tub 103 and the heater 144 is mounted in the heater mounting recess 145.

The sump 140 is installed at the bottom center portion of the wash tub 103 to collect and pump wash water. The sump 140 includes a wash water pump 142 to pump wash water at a high pressure and a pump motor 141 to drive the wash water pump 142.

The wash water pump 142 pumps wash water to the third nozzle assembly 130 through a first supply pipe 106, and pumps wash water to the first nozzle assembly 200 through a second supply pipe 108 diverged from the first supply pipe 106. In addition, the wash water pump 142 pumps wash water to the lowermost second nozzle assembly 120 through a third supply pipe 109.

The sump 140 may include a turbidity sensor (not shown) that detects the contamination degree of wash water. A controller (not shown) of the dishwasher 1 may detect the contamination degree of wash water using the turbidity sensor (not shown) and control the number of times a washing operation or a rinsing operation is performed. For example, the controller (not shown) may increase the number of times a washing or rinsing operation is performed when the contamination degree is high, and may reduce the number of times a washing or rinsing operation is performed when the contamination degree is low.

Figure 2:
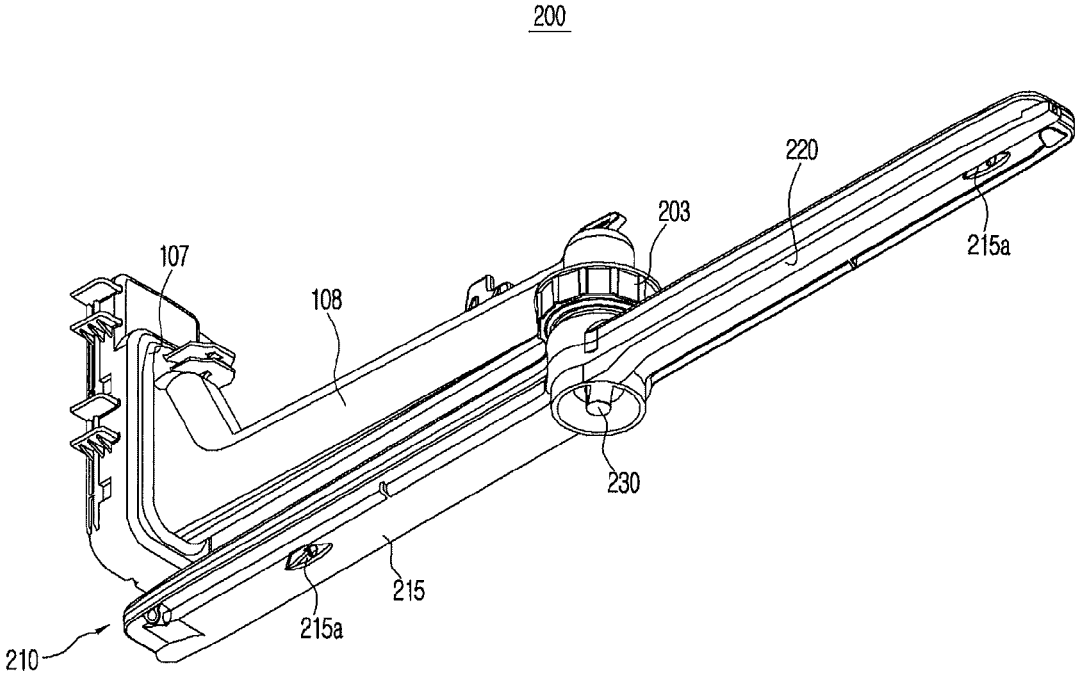
FIG. 2 is a view showing a first nozzle assembly according to an embodiment of the present disclosure.
Figure 3:
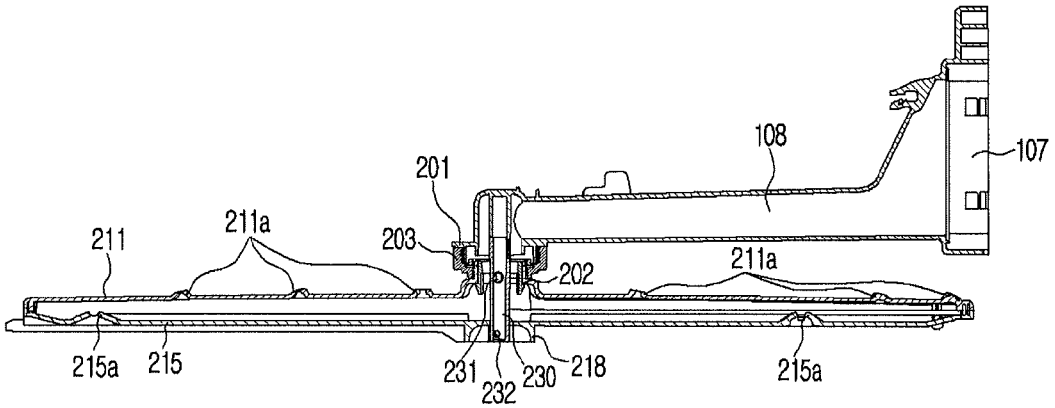
FIG. 3 is a sectional view showing the first nozzle assembly according to an embodiment of the present disclosure.
Figure 4:
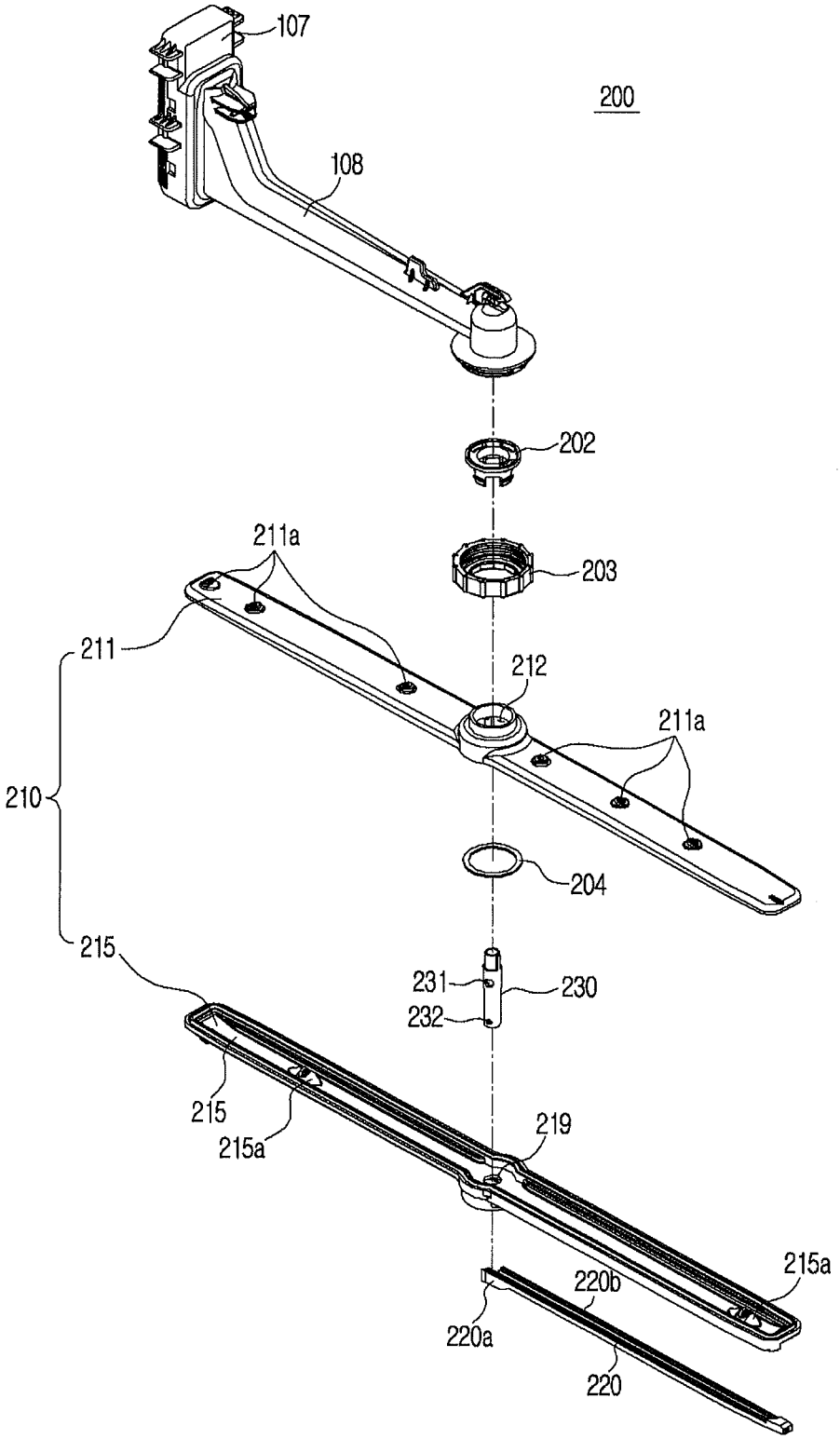
FIG. 4 is an exploded perspective view showing the first nozzle assembly according to an embodiment of the present disclosure.

FIG. 2 is a view showing the first nozzle assembly according to an embodiment of the present disclosure, FIG. 3 is a sectional view showing the first nozzle assembly according to an embodiment of the present disclosure, and FIG. 4 is an exploded perspective view showing the first nozzle assembly according to an embodiment of the present disclosure.

As exemplarily shown in FIGS. 2 to 4, the first nozzle assembly 200 is configured to spray wash water while being rotated. The first nozzle assembly 200 includes a main nozzle 210 that is rotatable about a rotation axis thereof. The main nozzle 210 is coupled to one end portion of the second supply pipe 108 to receive wash water. The other end portion of the second supply pipe 108 is coupled to the first supply pipe 106 such that wash water is supplied from the first supply pipe 106 to the second supply pipe 108. A coupler 107 may be located between the first supply pipe 106 and the second supply pipe 108.

The main nozzle 210 may be provided at an upper surface and/or a lower surface thereof with a plurality of injection holes 211*a*, 215*a* through which wash water is sprayed out. The main nozzle 210 may include an upper main nozzle 211 and a lower main nozzle 215 arranged at upper and lower portions, respectively. The upper main nozzle 211 and the lower main nozzle 215 may be fastened to each other, for example, via ultrasonic welding.

One or more coupling members 202, 203 may be provided to couple the first nozzle assembly 200 and the second supply pipe 108 to each other. The first coupling member 203 is coupled to the second supply pipe 108 and an outer surface of the main nozzle 210 to thereby couple the second supply pipe 108 and the main nozzle 210 to each other. Here, a vertical direction of the main nozzle 210 is referred to as a first direction and a horizontal direction of the main nozzle 210 is referred to as a second direction. The first coupling member 203 may control on/off of wash water sprayed out in the first direction of the main nozzle 210 through a first flow path.

The second coupling member 202 is located between the first coupling member 203 and the main nozzle 210 to achieve, for example, hook coupling between the first coupling member 203 and the main nozzle 210.

A shock-absorbing member 204 may be located between the second coupling member 202 and the lower main nozzle 215 to reduce contact friction between the second supply pipe 108 and the main nozzle 210 during rotation of the main nozzle 210. The shock-absorbing member 204 guides smooth rotation of the main nozzle 210.

The main nozzle 210 is constructed by coupling the upper main nozzle 211 and the lower main nozzle 215 to each other. The main nozzle 210 internally defines a first flow path for movement of wash water sprayed out in the first direction of the main nozzle 210.

A second flow path for movement of wash water sprayed out in the second direction of the main nozzle 210 is independent of the first flow path. The second flow path is defined in a sub nozzle 220. The sub nozzle 220 may be coupled to one surface of the main nozzle 210. According to an embodiment of the present disclosure, the sub nozzle 220 is coupled to a lower surface of the lower main nozzle 215, although the disclosure is not limited thereto. Accordingly, wash water moving in the first flow path is sprayed out toward objects. That is, the wash water may be sprayed out upward and/or downward of the main nozzle 210. Wash water moving in the second flow path is sprayed out in a radial direction of the main nozzle 210. According to an embodiment of the present disclosure, the sub nozzle 220 may be controlled to spray wash water only forward of the main nozzle 210.

The plurality of injection holes 211*a*, 215*a* may be positioned at the upper main nozzle 211 and the lower main nozzle 215. Here, the injection holes to spray wash water in the first direction are referred to as first injection holes, and the injection holes to spray wash water in the second direction are referred to as second injection holes. As exemplarily shown in the drawings, the lower main nozzle 215 is provided with two first injection holes 215*a* and the upper main nozzle 211 is provided with total six first injection holes 211*a*, although the disclosure is not limited thereto. The first injection holes 215*a* of the lower main nozzle 215 spray wash water downward of the main nozzle 210, so as to spray wash water toward the lower basket 104*b*. The first injection holes 211*a* of the upper main nozzle 211 spray wash water upward of the main nozzle 210, so as to spray wash water toward the upper basket 104*a*. In addition, as the first injection holes 215*a* of the lower main nozzle 215 spray wash water downward of the main nozzle 210, driving force to enable rotation of the main nozzle 210 is provided.

The sub nozzle 220 may have at least one second injection hole 221 for injection of wash water in the second direction. Wash water sprayed out through the second injection hole 221 is used to wash the detergent box 110 of the door 102.

The sub nozzle 220 may protrude forward from the main nozzle 210. This serves to prevent the main nozzle 210 from interfering with an injection path of wash water sprayed out in the second direction, thereby preventing unintentional switching of the injection direction of wash water.

The dishwasher 1 according to an embodiment of the present disclosure may further include a valve 230 coupled to the main nozzle 210 to open or close the second flow path. The valve 230 may be coupled to penetrate center holes 212, 219 respectively formed in the upper main nozzle 211 and the lower main nozzle 215. The valve 230 may have a first communication hole 231 communicating with the first flow path and a second communication hole 232 communicating with the second flow path. The first communication hole 231 and the second communication hole 232 may be open or closed via rotation of the main nozzle 210. According to an embodiment of the present disclosure, the valve 230 may penetrate the lower main nozzle 215 such that the second communication hole 232 of the valve 230 coupled to the lower main nozzle 215 is positioned outside the lower main nozzle 215. In addition, the lower main nozzle 215 may include a guide 218 configured to surround the second communication hole 232. Since the guide 218 has a curved surface, wash water discharged through the second communication hole 232 falls along the curved surface of the guide 218, thereby being sprayed out downward of the lower main nozzle 215. Opening or closing of the second flow path depending on rotation of the main nozzle 210 will be described later.

Figure 5:
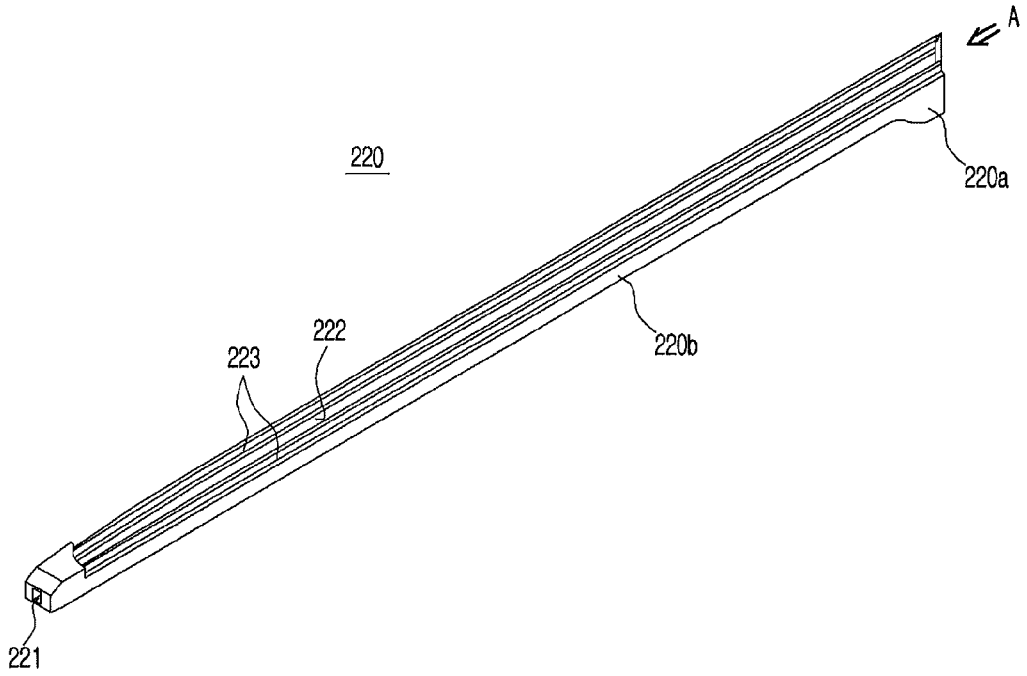
FIG. 5 is a view showing a sub nozzle disassembled from the first nozzle assembly according to an embodiment of the present disclosure.
Figure 6:
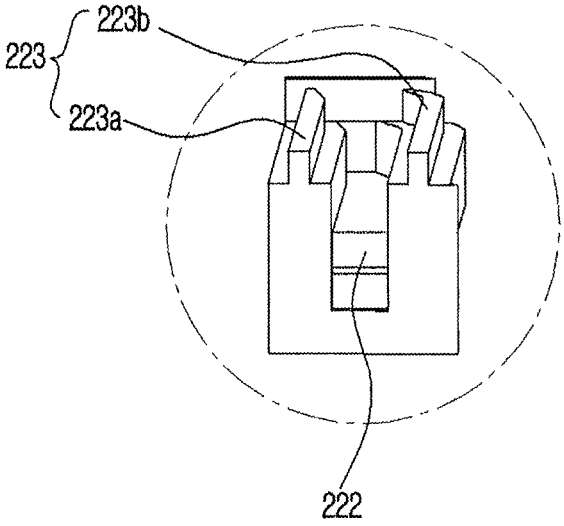
FIG. 6 is a view showing the sub nozzle viewed from direction A of FIG. 5.
Figure 7:
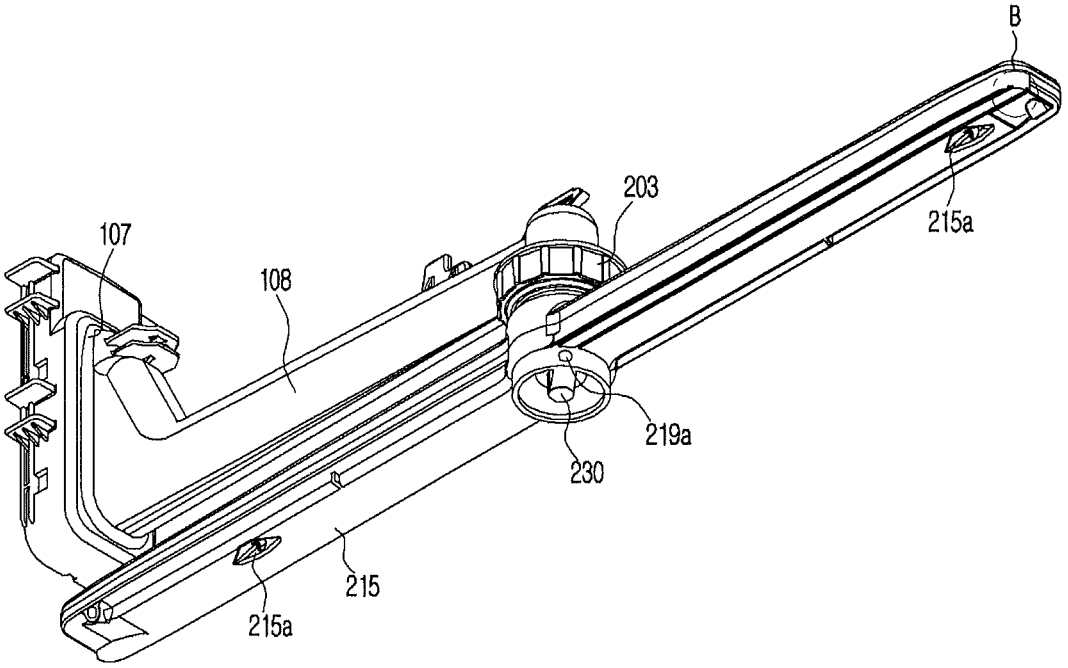
FIG. 7 is a view showing a main nozzle, to which the sub nozzle of the first nozzle assembly is coupled, according to an embodiment of the present disclosure.
Figure 8:
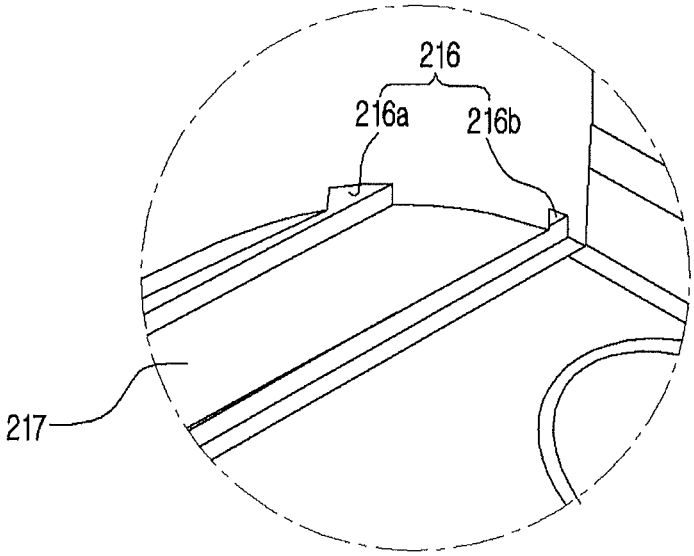
FIG. 8 is an enlarged view showing portion B of FIG. 7.

FIG. 5 is a view showing the sub nozzle disassembled from the first nozzle assembly according to an embodiment of the present disclosure, FIG. 6 is a view showing the sub nozzle viewed from direction A of FIG. 5, FIG. 7 is a view showing the main nozzle, to which the sub nozzle of the first nozzle assembly is coupled, according to an embodiment of the present disclosure, and FIG. 8 is an enlarged view showing portion B of FIG. 7.

As exemplarily shown in FIGS. 5 to 8, the sub nozzle 220 may be provided at one end portion thereof with the second injection hole 221, through which wash water is sprayed out toward the detergent box 110.

The sub nozzle 220 may include a first section 220*a* coupled to the guide 218 of the lower main nozzle 215, and a second section 220*b* extending from the first section 220*a*. In consideration of the fact that the first section 220*a* communicates with the second communication hole 232, the first section 220*a* may be expanded relative to the second section 220*b*. That is, the depth of the second flow path may be greater in the first section 220*a* than that in the second section 220*b*. This may prevent wash water discharged from the second communication hole 232 from leaking rather than being introduced into the second flow path.

The main nozzle 210 may have a connection portion 219*a* connecting the second communication hole 232 and the sub nozzle 220 to each other to allow wash water discharged from the second communication hole 232 to be introduced into the sub nozzle 220. The connection portion 219*a* may have a connection hole 219*b*, and the connection hole 219*b* may be connected to the second communication hole 232 of the valve 230 to enable movement of wash water into the second flow path.

The sub nozzle 220 may include a first coupling groove 222 to couple with the main nozzle 210. In addition, the sub nozzle 220 may include second coupling ridges 223 protruding upward from an upper surface thereof at opposite sides of the first coupling groove 222. The second coupling ridges may include a first coupling ridge portion 223*a* and a second coupling ridge portion 223*b* which are protruded upward from upper surface portion thereof at opposite sides of the first coupling groove 222 and spaced apart from each other by a predetermined length. This configuration increases a coupling surface area between the sub nozzle 220 and the lower main nozzle 215, thereby increasing coupling force between the sub nozzle 220 and the lower main nozzle 215.

A lower surface of the lower main nozzle 215 may have a configuration corresponding to the upper surface of the sub nozzle 220. The lower main nozzle 215 may be provided at the lower surface thereof with a first coupling ridge 217 protruding downward to correspond to the first coupling groove 222 of the sub nozzle 220. Second coupling grooves 216 may be formed at opposite sides of the first coupling ridge 217 to correspond to the second coupling ridges 223 of the sub nozzle 220. The second coupling grooves 216 may included a first coupling groove portion 216*a* and a second coupling groove portion 216*b* which are formed at opposite sides of the first coupling ridge 217 to correspond to the first and second coupling ridge portions 223*a* and 223*b* of the sub nozzle 220.

Figure 9:
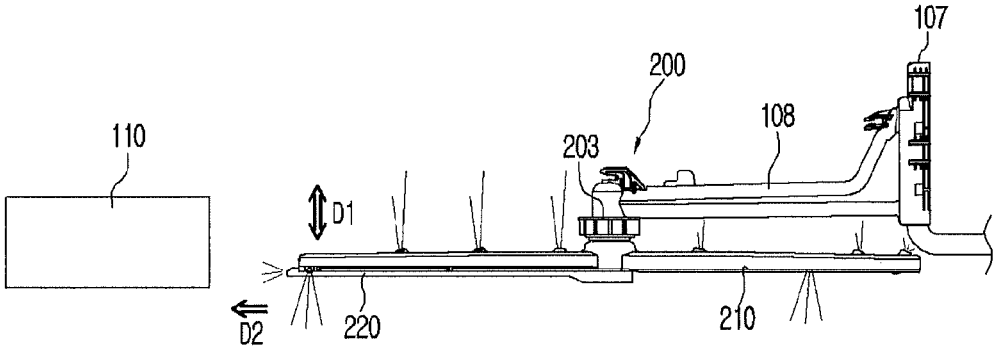
FIGS. 9 and 10 are views showing a detergent box and the first nozzle assembly according to an embodiment of the present disclosure.
Figure 10:
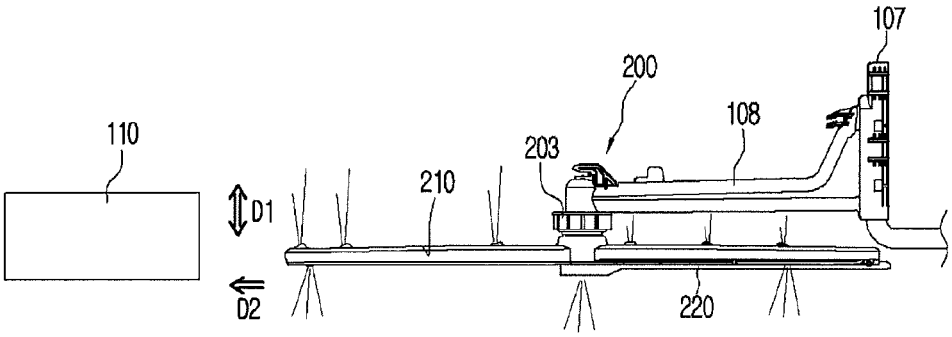

FIGS. 9 and 10 are views showing the detergent box and the first nozzle assembly according to an embodiment of the present disclosure.

FIG. 9 shows the case in which the sub nozzle 220 is located in a front region of the wash tub 103, and FIG. 10 shows the case in which the sub nozzle 220 is located in a rear region of the wash tub 103.

As exemplarily shown in FIG. 9, when the sub nozzle 220 is located in a front region of the wash tub 103 to face the detergent box 110, the second flow path is open such that wash water is sprayed out in the second direction D2 through the second injection hole 221. The wash water sprayed out through the second injection hole 221 washes the detergent box 110 located in front portion of the second injection hole 221. In addition, independently of the second flow path, wash water is sprayed out in the first direction D1 from the first flow path to wash objects.

As exemplarily shown in FIG. 10, when the sub nozzle 220 is located in a rear region of the wash tub 103 as the first nozzle assembly 200 is rotated, the second flow path does not coincide with the second communication hole 232, and thus is closed, which prevents injection of wash water in the second direction D2. However, since the first flow path is open, injection of wash water in the first direction D1 is implemented.

Figure 11A:
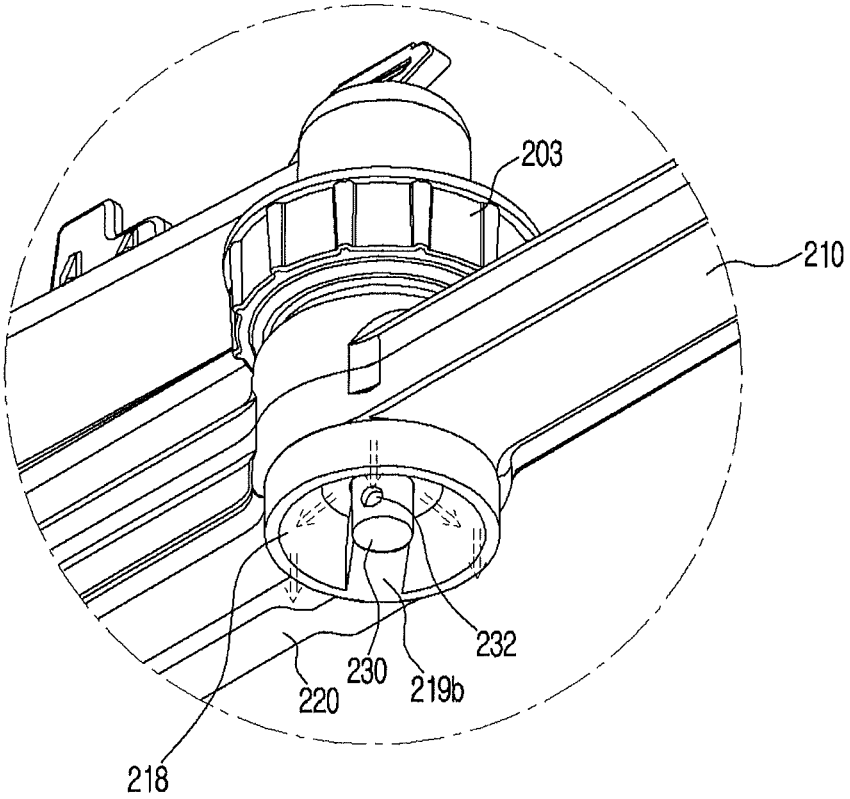
FIG. 11A is a view showing a closed state of a second flow path defined in the first nozzle assembly according to an embodiment of the present disclosure.
Figure 11B:
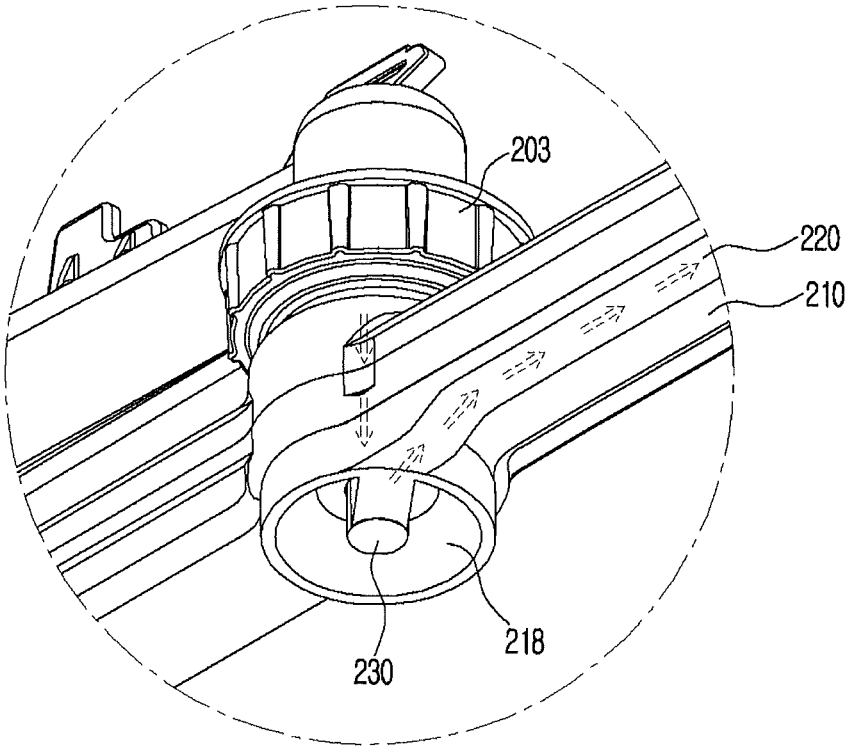
FIG. 11B is a view showing an open state of the second flow path defined in the first nozzle assembly according to an embodiment of the present disclosure.

FIG. 11A is a view showing a closed state of the second flow path defined in the first nozzle assembly according to an embodiment of the present disclosure, and FIG. 11B is a view showing an open state of the second flow path defined in the first nozzle assembly according to an embodiment of the present disclosure. In the drawings, arrows represent a movement direction of wash water.

As exemplarily shown in FIG. 11A, when the second flow path defined in the sub nozzle 220 is closed, wash water having passed through the second communication hole 232 of the valve 230 may be sprayed out downward of the main nozzle 210. This injection of wash water in the closed state of the second flow path may be guided by the guide 218 formed at the lower surface of the main nozzle 210. Specifically, the guide 218 may be formed at the lower surface of the lower main nozzle 215. In addition, providing the guide 218 with a curved surface may more reliably ensure guidance of wash water from the second communication hole 232 downward of the main nozzle 210. That is, the guide 218, which protrudes downward from the lower surface of the lower main nozzle 215 and has a concavely recessed inner surface, may guide wash water sprayed out from the second communication hole 232 to move downward of the main nozzle 210.

As exemplarily shown in FIG. 11B, when positions of the second flow path and the second communication hole 232 coincide with each other to realize communication between the second flow path and the second communication hole 232, the second flow path is open. Thereby, wash water sprayed out from the second communication hole 232 may move through the second flow path defined in the sub nozzle 220. In this case, wash water is sprayed out forward of the main nozzle 210.

As described above, when the second flow path defined in the sub nozzle 220 and the second communication hole 232 come to the same position as the main nozzle 210 is rotated, the second flow path is open so that wash water is sprayed out forward of the main nozzle 210 through the second injection hole 221. In addition, when the second flow path defined in the sub nozzle 220 and the second communication hole 232 come to different positions as the main nozzle 210 is rotated, the second flow path is closed so that wash water is sprayed out downward of the main nozzle 210 from the second communication hole 232. In this way, wash water is sprayed out forward of the main nozzle 210 only when the sub nozzle 220 faces the detergent box 110, and is not sprayed out forward of the main body 210, but sprayed out downward of the main nozzle 210 when the sub nozzle 220 does not face the detergent box 110. This may reduce a contact area between wash water and the main body 101, thereby reducing noise generated in the dishwasher 1. In addition, since the second communication hole 232 is located outside the main nozzle 210, there may be no risk of leakage of water due to the water pressure, which may facilitate injection of wash water forward of the main nozzle 210.

Figure 12:
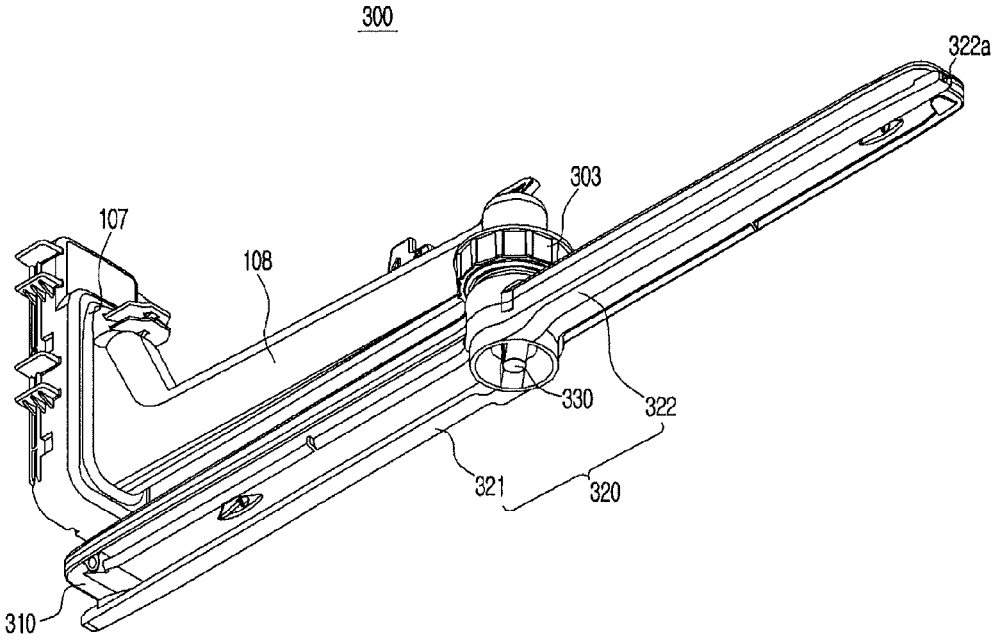
FIG. 12 is a view showing a first nozzle assembly according to another embodiment of the present disclosure.

FIG. 12 is a view showing a first nozzle assembly according to another embodiment of the present disclosure.

As exemplarily shown in FIG. 12, a first nozzle assembly 300 may include a plurality of sub nozzles 320. Although the drawing shows the sub nozzles 320 as including a first sub nozzle 321 and a second sub nozzle 322, the disclosure is not limited thereto. The plurality of sub nozzles 320 may be coupled to a main nozzle 310 at opposite sides of a valve 330. Thus, a plurality of second flow paths may be provided. In this case, proper positioning of a second communication hole (not shown) formed in the valve 330 may allow wash water to be sprayed out forward of the main nozzle 310 only at a prescribed position of the second communication hole (not shown). A first nozzle assembly 300 may include a first coupling member 303, a second coupling member (not shown). The first coupling member 303 is coupled to the second supply pipe 108 and an outer surface portion of the main nozzle 310 to thereby couple the second supply pipe 108 and the main nozzle 310 to each other. The second sub nozzle 322 may be provided at one end portion thereof with a second injection hole 322*a*. When positions of the second flow path and the second communication hole (not shown) coincide with each other, wash water may be sprayed out forward of the main nozzle 310 from the sub nozzle 320 through the second injection hole 322*a*.

Figure 13:
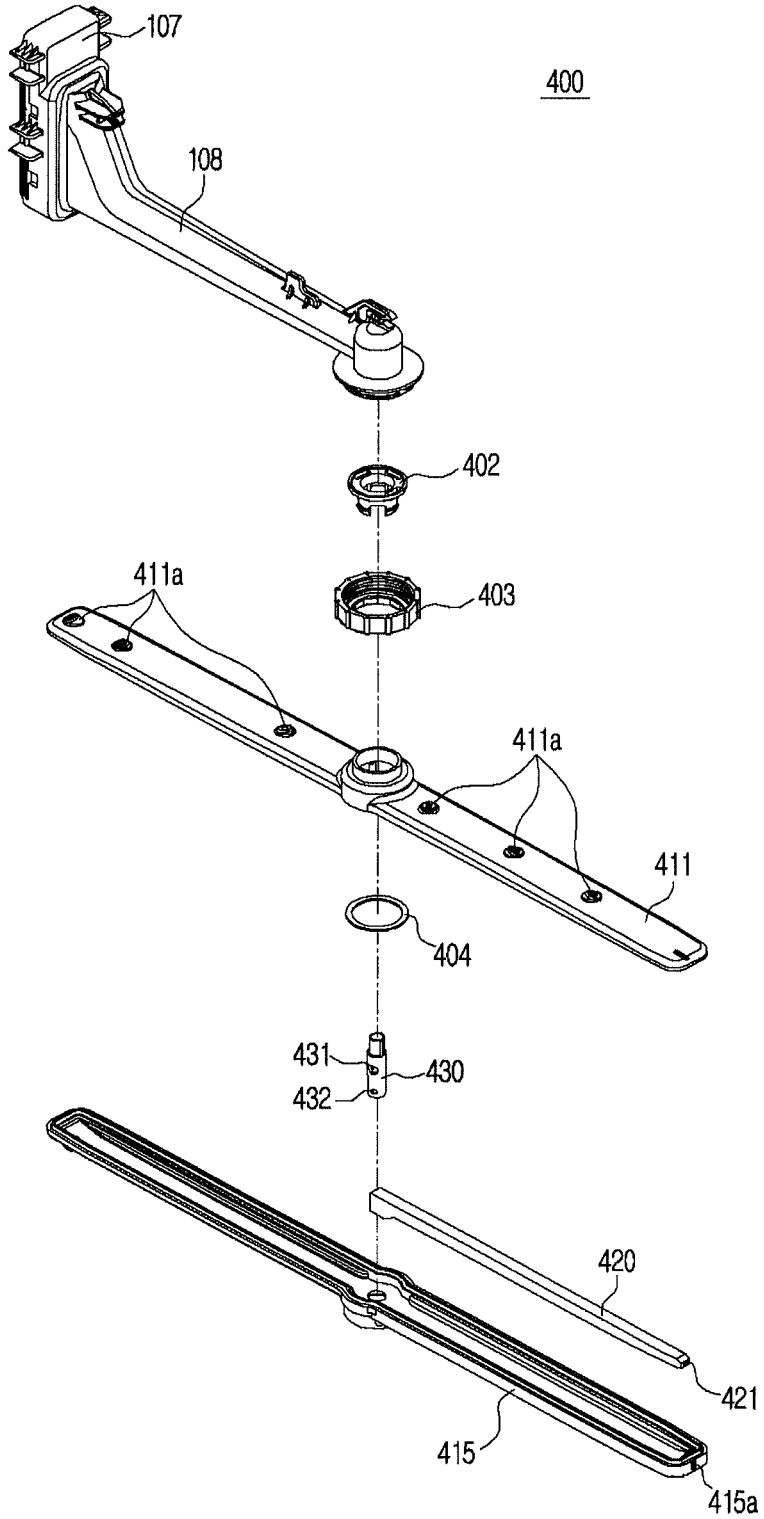
FIG. 13 is an exploded perspective view showing a first nozzle assembly according to an embodiment of the present disclosure.
Figure 14:
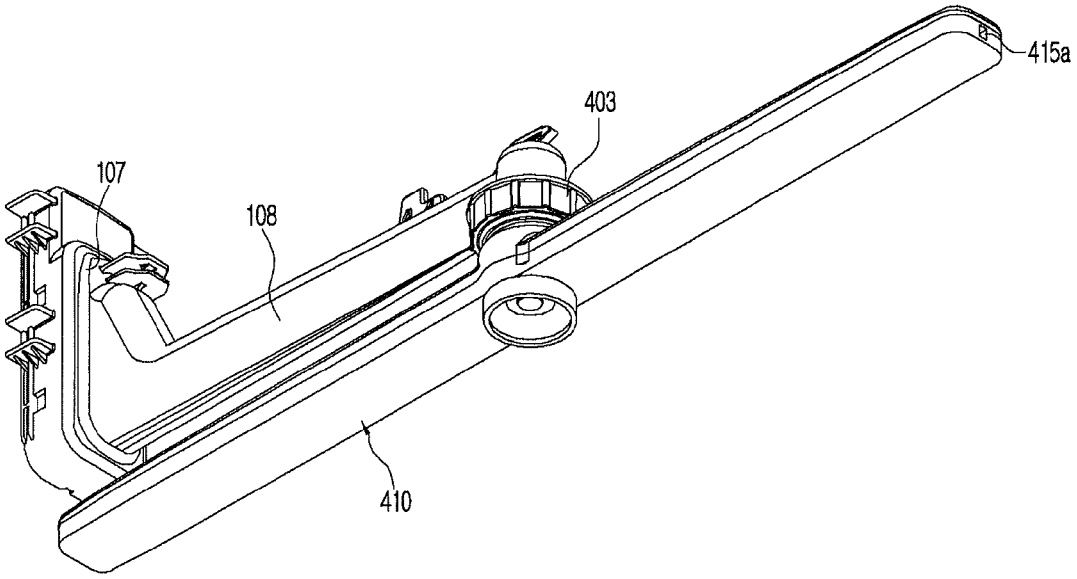
FIG. 14 is a view showing the first nozzle assembly according to an embodiment of the present disclosure.

FIG. 13 is an exploded perspective view showing a first nozzle assembly according to an embodiment of the present disclosure, and FIG. 14 is a view showing the first nozzle assembly according to an embodiment of the present disclosure.

As exemplarily shown in FIGS. 13 and 14, according to an embodiment, a sub nozzle 420 may be placed in a main nozzle 410. In this case, with regard to that wash water moves to the main nozzle 410 by passing through the coupler 107 and the second supply pipe 108, an embodiment is equivalent to those of the above description. In addition, likewise, a first nozzle assembly 400 may include a first coupling member 403, a second coupling member 402, and a shock-absorbing member 404, and the main nozzle 410 may include an upper main nozzle 411 and a lower main nozzle 415. The main nozzle 410 may be provided at an upper surface portion and/or a lower surface portion thereof with a plurality of injection holes 411*a* through which wash water is sprayed out.

When the sub nozzle 420 is placed in the main nozzle 410, a second communication hole 432 may be located inside the main nozzle 410, rather than outside the main nozzle 410. As such, the valve 430 may not protrude outward from the main nozzle 410.

The sub nozzle 420 is provided at one end portion thereof with an inner second injection hole 421. In this case, the main nozzle 410 may be provided at one end portion thereof with an outer second injection hole 415*a* to communicate with the inner second injection hole 421. According to the further embodiment, the outer second injection hole 415*a* may be formed in the lower main nozzle 415. When positions of the second flow path and the second communication hole 432 coincide with each other, wash water may be sprayed out forward of the main nozzle 410 from the sub nozzle 420 through the inner second injection hole 421 and the outer second injection hole 415*a*.

As is apparent from the above description, according to an aspect of the present disclosure, a nozzle assembly includes a first flow path and a second flow path independent of each other, which enables controllable injection of wash water such that wash water is sprayed out only in a zone where washing of a detergent box is necessary and is not sprayed out in a zone where washing of the detergent box is unnecessary. In this way, it may be possible to reduce generation of noise due to collision of wash water.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A dishwasher comprising:

a main body;

a wash tub placed within the main body to receive objects to be washed therein;

at least one first nozzle assembly located within the wash tub to wash the objects received in the wash tub, the first nozzle assembly being configured to spray wash water while being rotated; and a detergent box to supply detergent into the wash tub, wherein the first nozzle assembly includes:

a main nozzle configured to be rotatable about a rotation axis thereof;

a plurality of first injection holes provided at the main nozzle to spray the wash water to the objects in the wash tub;

at least one sub nozzle provided at the main nozzle, the sub nozzle having a second injection hole to spray the wash water to the detergent box and a flow path for movement of wash water to the second injection hole; and a valve coupled to the main nozzle to open or close the second flow path, wherein the valve is arranged to control spraying of wash water through the sub nozzle based on a position of the main nozzle, in which the flow path is opened when the sub nozzle is located in a front region of the wash tub to face the detergent box and the flow path is closed when the sub nozzle is located in a rear region of the wash tub.

2. The dishwasher according to claim 1, wherein the valve includes a first communication hole to communicate with a first flow path defined in the main nozzle for movement of wash water to the plurality of first injection holes and a second communication hole to communicate with a second flow path for movement of wash water to the second injection hole.

3. The dishwasher according to claim 2, wherein the sub nozzle is coupled to an outer surface portion of the main nozzle.

4. The dishwasher according to claim 3, wherein a portion of the valve where the second communication hole is located is exposed outside the main nozzle.

5. The dishwasher according to claim 3, wherein the at least one sub nozzle is coupled to a portion of the main nozzle where the at least one sub nozzle does not interfere with the plurality of first injection holes.

6. The dishwasher according to claim 1, wherein the at least one sub nozzle is located inside the main nozzle.

7. The dishwasher according to claim 1, further comprising a guide configured to guide the wash water from the second communication hole downward of the main nozzle when the flow path is closed.

8. The dishwasher according to claim 7, wherein the guide is provided at a lower surface of the main nozzle and has a curved inner surface to guide the wash water from the second communication hole when the second flow path is closed.

9. The dishwasher according to claim 1, wherein the at least one sub nozzle includes a plurality of sub nozzles.

10. The dishwasher according to claim 1, further comprising a second nozzle assembly, the second nozzle assembly including a plurality of third injection holes to wash the objects received in the wash tub, the third injection holes being configured to linearly spray the wash water, and a switching unit configured to be linearly moved relative to the third injection holes to switch an injection direction of wash water.

11. The dishwasher according to claim 10, wherein the at least one first nozzle assembly is located above a basket placed in the wash tub and the second nozzle assembly is located below the basket.

12. The dishwasher according to claim 1, further comprising:

a supply pipe to supply the wash water into the at least one first nozzle assembly; and at least one coupling member to couple the supply pipe to the at least one first nozzle assembly.

13. The dishwasher according to claim 12, further comprising a shock-absorbing member coupled between the at least one coupling member and the main nozzle to reduce friction between the main nozzle and the supply pipe.

14. A dishwasher comprising:

a main body;

a wash tub placed within the main body to receive objects to be washed therein;

at least one first nozzle assembly located within the wash tub and configured to spray wash water to wash the objects received in the wash tub, the at least one first nozzle assembly including:

a main nozzle configured to be rotatable about a rotation axis thereof, the main nozzle having a first flow path defined in an inner portion of the main nozzle and the wash water is to be flowed through the first flow path and to be sprayed out in a first direction; and a sub nozzle provided at the main nozzle, the sub nozzle having a second flow path defined in an inner portion of the sub nozzle and the wash water is to be flowed through the second flow path and to be sprayed out in a second direction; and a valve coupled to the main nozzle and configured to control spraying of the wash water through while the main nozzle is rotating, wherein the second flow path is open so that the wash water is flowed therethrough when the sub nozzle is located in a front region of the wash tub and is closed so that the wash water is prevented from flowing therethrough when the sub nozzle is located in a rear region of the wash tub.

15. The dishwasher according to claim 14, wherein the first direction is an upward direction which the wash water flowing through the first flow path is sprayed out, and the second direction is a horizontal direction which the wash water flowing through the second flow path is sprayed out.

16. The dishwasher according to claim 14, the valve including a first communication hole to communicate with the first flow path and a second communication hole to communicate with the second flow path, the second communication hole of the valve being selectively open or closed.

17. The dishwasher according to claim 16, further comprising a guide configured to come into contact with the wash water from the second communication hole to guide the wash water from the second communication hole downward of the main nozzle when the second communication hole is closed.

18. A dishwasher comprising:

a main body;

a wash tub placed within the main body to receive objects therein; and at least one first nozzle assembly located within the wash tub and configured to spray wash water to the objected received in the wash tub, the at least one first nozzle assembly including:

a main nozzle configured to be rotatable about a rotation axis thereof;

at least one sub nozzle coupled to the main nozzle;

at least one first injection hole formed in the main nozzle, through which wash water is sprayed out in a first direction;

at least one second injection hole formed in the sub nozzle, through which wash water is sprayed out in a second direction; and a valve coupled to the main nozzle and, at least a portion of which communicates with the sub nozzle, to adjust spraying of wash water through the second injection hole while the main nozzle is rotating, the valve including:

a first communication hole positioned inside the main nozzle to communicate with the main nozzle to introduce the wash water to the main nozzle therethrough; and a second communication hole exposed outside the main nozzle to communicate with the sub nozzle to introduce the wash water to the sub nozzle therethrough.

19. The dishwasher according to claim 18, wherein the first direction is a vertical direction of the main nozzle, and the second direction is a radial direction of the main nozzle.

20. The dishwasher according to claim 18, wherein the second injection hole is located at a radial distal end portion of the sub nozzle.

21. The dishwasher according to claim 18, wherein the main nozzle includes a connection portion to connect the second communication hole to the sub nozzle such that wash water discharged from the second communication hole is introduced into the sub nozzle.

* * * * *